US009243637B2

(12) United States Patent
Inada et al.

(10) Patent No.: US 9,243,637 B2
(45) Date of Patent: Jan. 26, 2016

(54) SCROLL COMPRESSOR REDUCING OVER-COMPRESSION LOSS

(75) Inventors: Yukihiro Inada, Sakai (JP); Takazou Sotojima, Sakai (JP); Yoshitaka Shibamoto, Sakai (JP); Kenichi Sata, Sakai (JP); Kazuhiko Matsukawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 54 days.

(21) Appl. No.: 14/232,766

(22) PCT Filed: Jun. 22, 2012

(86) PCT No.: PCT/JP2012/004078

§ 371 (c)(1), (2), (4) Date: Jan. 14, 2014

(87) PCT Pub. No.: WO2013/011631

PCT Pub. Date: Jan. 24, 2013

(65) Prior Publication Data

US 2015/0037189 A1 Feb. 5, 2015

(30) Foreign Application Priority Data

Jul. 15, 2011 (JP) ..... 2011-157078

(51) Int. Cl.
*F03C 2/00* (2006.01)
*F03C 4/00* (2006.01)
(Continued)

(52) U.S. Cl.
CPC ..... *F04C 18/0215* (2013.01); *F01C 1/0215* (2013.01); *F01C 1/0246* (2013.01); *F01C1/0269* (2013.01); *F04C 18/0246* (2013.01); *F04C 18/0269* (2013.01); *F04C 23/008* (2013.01)

(58) Field of Classification Search
CPC ..... F04C 18/0215; F04C 18/0246; F04C 18/0269; F04C 23/008; F04C 1/0246; F01C 1/0215; F01C 1/0269
USPC ..... 418/55.1–55.6, 57, 142, 270
See application file for complete search history.

(56) References Cited

U.S. PATENT DOCUMENTS 2,324,168 A * 7/1943 Montelius ..... 418/55.2
4,627,800 A * 12/1986 Matsudaira et al. ..... 418/55.2
(Continued)

FOREIGN PATENT DOCUMENTS

JP 64-63686 A 3/1989
JP 3-172594 A 7/1991
(Continued)

OTHER PUBLICATIONS

International Preliminary Report of corresponding PCT Application No. PCT/JP2012/004078, dated on Jul. 24, 2012.
(Continued)

*Primary Examiner* — Theresa Trieu
(74) *Attorney, Agent, or Firm* — Global IP Counselors

(57) ABSTRACT

A scroll compressor includes a fixed scroll and an orbiting scroll. Each of the fixed and orbiting scrolls includes an end plate and a spiral wrap standing on a front surface of the end plate. The scrolls are arranged such that the front surfaces of the end plates face each other and the wraps are engaged with each other. The orbiting scroll eccentrically rotates, without turning on an axis thereof, with respect to the fixed scroll to compress fluid in compression chambers respectively formed inside and outside the wrap of the orbiting scroll. Each wrap is formed in a shape such that at least one of the compression chambers serves as a rate-reduced compression chamber where a volume change rate thereof is reduced in a middle of a compression phase.

7 Claims, 9 Drawing Sheets

(51) Int. Cl.

| | |
|---|---|
| ***F04C 2/00*** | (2006.01) |
| ***F04C 18/02*** | (2006.01) |
| ***F01C 1/02*** | (2006.01) |
| *F04C 23/00* | (2006.01) |

(56) References Cited

U.S. PATENT DOCUMENTS

| | | | | |
|---|---|---|---|---|
| 5,056,336 | A | 10/1991 | Harrison | |
| 5,938,417 | A * | 8/1999 | Takao et al. | 418/55.2 |
| 2010/0221133 | A1 | 9/2010 | Nishikawa et al. | |

FOREIGN PATENT DOCUMENTS

| | | | |
|---|---|---|---|
| JP | 2000-314384 | A | 11/2000 |
| JP | 2002-364562 | A | 12/2002 |
| JP | 2008-286095 | A | 11/2008 |

OTHER PUBLICATIONS

International Search Report of corresponding PCT Application No. PCT/JP2012/004078, dated on Jul. 24, 2012.

* cited by examiner

SCROLL COMPRESSOR REDUCING OVER-COMPRESSION LOSS

CROSS-REFERENCE TO RELATED APPLICATIONS

This U.S. National stage application claims priority under 35 U.S.C. §119(a) to Japanese Patent Application No. 2011-157078, filed in Japan on Jul. 15, 2011, the entire contents of which are hereby incorporated herein by reference.

TECHNICAL FIELD

The present disclosure relates to a scroll compressor. In particular, the present disclosure relates to measures against reduction in over-compression loss.

BACKGROUND ART

Conventionally, a scroll compressor including, in a casing thereof, an electric motor and a scroll compression mechanism has been known (see, e.g., Japanese Unexamined Patent Publication No. 2008-286095). In the compression mechanism of the scroll compressor, a fixed scroll and an orbiting scroll each including an end plate and a wrap standing on a front surface of the end plate and engaged, at the wraps thereof, with each other with the from surfaces of the end plates facing each other are provided. In such a scroll compressor, the orbiting scroll eccentrically rotates with respect to the fixed scroll to change the shape of each compression chamber formed between the wraps of the scrolls, thereby compressing fluid in the compressor. Fluid is sucked into the compression chambers from an outer circumferential side of the scrolls of the compression mechanism. Then, while the compression chambers are being deformed, the fluid flows toward a center part of the compression mechanism. When the pressure of the fluid reaches a predetermined pressure, the fluid is discharged from the center part of the compression mechanism.

SUMMARY

Technical Problem

In the foregoing scroll compressor, a discharge phase begins when the wraps of the fixed scroll and the orbiting scroll are, at the innermost contact point therebetween, separated from each other to cause the compression chamber to communicate with a discharge port. However, right after the discharge phase begins, the volume of the compression chamber decreases, as in a compression phase, with eccentric rotation of the orbiting scroll in spite of a small cross-sectional area of a passage through which the compression chamber and the discharge port communicate with each other. Thus, although the discharge phase begins, fluid is further compressed in the compression chamber. Accordingly, it is likely that the pressure of the fluid exceeds a discharge pressure, i.e., over-compression occurs. In particular, since the tendency has recently been toward higher speed operation of compressors, a pressure loss due to the over-compression described above increases, and, as a result, the ratio of the over-compression loss to the total loss increases.

The foregoing over-compression of fluid in the compression chamber during the discharge phase may be reduced in such a manner that, e.g., the number of turns of the wrap is increased to extend a fluid compression passage and such extension reduces the rate of change in volume of the compression chamber. However, in the case where the number of turns of the wrap is simply increased to extend the compression passage, there is a disadvantage that the size of the compression mechanism is increased and therefore the size of the scroll compressor is also increased.

The present disclosure has been made in view of the foregoing, and aims to reduce, in a scroll compressor, an over-compression loss without increasing the size of the scroll compressor.

Solution to the Problem

A first aspect of the invention is intended for a scroll compressor including a fixed scroll (31) and an orbiting scroll (36) each including an end plate (32, 7) and a spiral wrap (34, 38) standing on a front surface of the end plate (32, 37). The fixed scroll (31) and the orbiting scroll (36) are arranged such that the front surfaces of the end plates (32, 37) face each other and that the wraps (34, 38) are engaged with each other. The orbiting scroll (36) eccentrically rotates, without turning on an axis thereof, with respect to the fixed scroll (31) to compress fluid in compression chambers (41A, 41B) respectively formed inside and outside the wrap (38) of the orbiting scroll (36). Each wrap (34, 38) of the fixed scroll (31) and the orbiting scroll (36) is formed in such a shape that at least one (41B) of the compression chambers (41A, 41B) serves as a rate-reduced compression chamber (41B) where a volume change rate thereof is reduced in middle of a compression phase.

In the first aspect of the invention, the volume of the two compression chambers (41A, 41B) decreases, by eccentric rotation of the orbiting scroll (36), to compress fluid in both compression chambers (41A, 41B), and at least one (41B) of the compression chambers (41A, 41B) serves as the rate-reduced compression chamber (41B) where the volume change rate is reduced in the middle of the compression phase. In the rate-reduced compression chamber (41B), the volume change rate upon completion of the compression phase is lower than that upon start of the compression phase. That is, the volume change rate right after the beginning of the discharge phase of the rate-reduced compression chamber (41B) is at a relatively-small value. In a scroll compressor, the cross-sectional area of a communication passage between a compression chamber and a discharge port through which fluid is discharged is small right after the beginning of a discharge phase. However, since the volume change rate of the rate-reduced compression chamber (41B) is at the relatively-small value upon completion of the compression phase, useless compression of fluid to a pressure exceeding a discharge pressure is reduced in the rate-reduced compression chamber (41B) right after the beginning of the discharge phase.

A second aspect of the invention is intended for the scroll compressor of the first aspect of the invention, in which each wrap (34, 38) of the fixed scroll (31) and the orbiting scroll (36) is formed in an involute curve shape, and a side surface (34*b*, 38*b*) of each wrap (34, 38) facing the rate-reduced compression chamber (41B) is formed in a shape of a modified involute curve such that a base circle radius decreases in a stepwise manner from an outer end to an inner end of each wrap (34, 38).

In the second aspect of the invention, the side surface (34*b*, 38*b*) of each wrap (34, 38) of the fixed scroll (31) and the orbiting scroll (36) facing the rate-reduced compression chamber (41B) is, as described above, formed in the shape of the modified involute curve such that the base circle radius decreases in the stepwise manner from the outer end to the inner end.

For involute curves having the same radius of curvature at an outer end, a smaller radius of a base circle results in an increase in the number of turns, and therefore results in an increase in length of the involute curve. Thus, if a wrap formed in the shape of an involute curve to a base circle having a small diameter is used, a refrigerant compression passage is extended, and the rate of change in volume of a compression chamber is reduced. That is, if the side surface (34*b*, 38*b*) of each wrap (34, 38) of the fixed scroll (31) and the orbiting scroll (36) facing the rate-reduced compression chamber (41B) is, as described above, formed in the shape of the modified involute curve such that the base circle radius decreases in the stepwise manner from the outer end to the inner end, the volume change rate of the rate-reduced compression chamber (41B) is reduced as the orbiting scroll (3 eccentrically rotates.

A third aspect of the invention is intended for the scroll compressor of the second aspect of the invention, in which each wrap (34, 38) of the fixed scroll (31) and the orbiting scroll (36) is configured such that the modified involute curve has a change point (P1, P2) at which the base circle radius changes, and abuse circle of an involute curve on an inner end side relative to the change point (P1, P2) and a base circle of an involute curve on an outer end side relative to the change point (P1, P2) have an identical tangent line (L1, L2) passing through the change point (P1, P2).

In the third aspect of the invention, the base circle of the involute curve on the outer end side relative to the change point and the base circle of the involute curve on the inner end side relative to the change point are not arranged so as to be concentric to each other, but the small-diameter base circle is inscribed in the large-diameter base circle. The base circle radius changes on the tangent line to such an inscription point. That is, the involute curve to the large-diameter base circle and the involute curve to the small-diameter base circle are connected together on the foregoing tangent line. Since the involute curves to the base circles having different diameters are connected together as described above, the two types of involute curves can be smoothly connected together.

A fourth aspect of the invention is intended for the scroll compressor of any one of the first to third aspects of the invention, in which each wrap (34, 38) of the fixed scroll (31) and the orbiting scroll (36) is formed such that the volume change rate of the rate-reduced compression chamber (41B) changes, with eccentric rotation of the orbiting scroll (36), from a first volume change rate to a second volume change rate lower than the first volume change rate, and the change in volume change rate is completed when a rotation angle of the orbiting scroll (36) falls within a range of plus or minus 90 degrees of an angle at which the discharge phase begins in the rate-reduced compression chamber (41B).

In the fourth aspect of the invention, the volume change rate of the rate-reduced compression chamber (41B) changes from the first volume change rate to the second volume change rate as the orbiting scroll (36) eccentrically rotates. Such a change in volume change rate is completed when the eccentric rotation angle of the orbiting scroll (36) falls within a range of plus or minus 90 degrees of the discharge start angle at which the discharge phase begins in the rate-reduced compression chamber (41B).

As described above, in a scroll compressor, the cross-sectional area of a communication passage between a compression chamber and a discharge port through which refrigerant is discharged is small after a discharge phase begins and before an orbiting scroll rotates about 90 degrees. For such a reason, the change in volume change rate of the reduced-rate compression chamber (41B) is preferably completed before the discharge phase begins in the rate-reduced compression chamber (41B), or is, even after the beginning of the discharge phase, preferably completed until the orbiting scroll (36) rotates about 90 degrees. However, if the change in volume change rate of the rate-reduced compression chamber (41B) is completed, e.g., right after the beginning of the compression phase, there is a possibility that a desired compression ratio cannot be ensured due to a reduced suction volume. Thus, the foregoing configuration is employed, in which the change in volume change rate is completed when the eccentric rotation angle of the orbiting scroll (36) falls within a range of plus or minus 90 degrees of the discharge start angle. As a result, it can be ensured that the volume change rate of the rate-reduced compression chamber (41B) is reduced right after the beginning of the discharge phase, i.e., in the state in which over-compression is likely to occur. In addition, a great suction volume can be ensured.

A fifth aspect of the invention is intended for the scroll compressor of any one of the first to fourth aspects of the invention, in which each wrap (34, 38) of the fixed scroll (31) and the orbiting scroll (36) is formed in an asymmetric shape, and is formed such that at least the compression chamber (41B) formed inside the wrap (38) of the orbiting scroll (36) serves as the rate-reduced compression chamber (41B).

In the fifth aspect of the invention, the wraps (34, 38) of the fixed scroll (31) and the orbiting scroll (36) are each formed in an asymmetric shape. In such a case, since the compression passage is shorter in the compression chamber formed inside the wrap of the orbiting scroll (36) than in the compression chamber formed outside the wrap of the orbiting scroll (36), the volume change rate is higher in the inner compression chamber than in the outer compression chamber, and the volume change rate increases as the orbiting scroll (36) eccentrically rotates. For such a reason, over-compression is more likely to occur in the compression chamber formed inside the wrap of the orbiting scroll (36) than in the compression chamber formed outside the wrap of the orbiting scroll (36), and an over-compression loss is greater in the inner compression chamber than the outer compression chamber. However, in the fifth aspect of the invention, each wrap (34, 38) is formed such that at least the compression chamber (41B) serves as the rate-reduced compression chamber where the volume change rate thereof is reduced in the middle of the compression phase. Thus, over-compression is less likely to occur in the inner compression chamber (41B).

A sixth aspect of the invention is intended for the scroll compressor of the first aspect of the invention, in which a plurality of arc-shaped parts (34A-34E, 38A-38D) continuing each other such that an arc radius decreases from an outer end to an inner end of each wrap (34, 38) firm each wrap (34, 38) of the fixed scroll (31) and the orbiting scroll (36), and in each wrap (34, 38) of the fixed scroll (31) and the orbiting scroll (36), some (34C, 34E, 38B, 38D) of the arc-shaped parts (34A-34E, 38A-38D) each have a thickness changing from the outer end to the inner end of each wrap (34, 38) such that the volume change rate of the rate-reduced compression chamber (41A, 41B) is reduced in the middle of the compression phase.

In the sixth aspect of the invention, the plurality of arc-shaped parts (34A-34E, 38A-38D) continuing each other such that the arc radius decreases from the outer end to the inner end of each wrap (34, 38) form each wrap (34, 38) of the fixed scroll (31) and the orbiting scroll (36). In each wrap (34, 38) of the fixed scroll (31) and the orbiting scroll (36), some (34C, 34E, 38B, 38D) of the arc-shaped parts (34A-34E, 38A-38D) each have the changing thickness such that the volume change rate of the rate-reduced compression chamber (41A, 41B) is reduced in the middle of the compression phase.

Advantages of the Invention

According to the first aspect of the invention, each wrap (34, 38) of the fixed scroll (31) and the orbiting scroll (36) is formed in such a shape that at least one (41B) of the two compression chambers (41A, 41B) serves as the rate-reduced compression chamber (41B) where the volume change rate thereof is reduced in the middle of the compression phase. In a scroll compressor, the cross-sectional area of a communication passage between a compression chamber and a discharge port through which fluid is discharged is small right after the beginning of a discharge phase. However, since the volume change rate of the rate-reduced compression chamber (41B) is at the relatively-small value upon completion of the compression phase, over-compression of fluid in the rate-reduced compression chamber (41B) right after the beginning of the discharge phase can be reduced. Accordingly, the over-compression loss can be reduced. Moreover, since each wrap (34, 38) of the fixed scroll (31) and the orbiting scroll (36) is configured such that the volume change rate of the rate-reduced compression chamber (41B) is reduced in the middle of the compression phase, the over-compression loss can be reduced without increasing the size of the scroll compressor.

According to the second aspect of the invention, since the side surface (34*b*, 38*b*) of each wrap (34, 38) of the fixed scroll (31) and the orbiting scroll (36) facing the rate-reduced compression chamber (41B) is formed in the shape of the modified involute curve such that the base circle radius decreases in the stepwise manner from the outer end to the inner end, the wrap (34, 38) can be easily formed in such a shape that the volume change rate of the rate-reduced compression chamber (41B) is reduced in the middle of the compression phase. Moreover, since the side surface (34*b*, 38*b*) of each wrap (34, 38) of the fixed scroll (31) and the orbiting scroll (36) facing the rate-reduced compression chamber (41B) is formed in the shape of the modified involute curve such that the base circle radius decreases in the stepwise manner from the outer end to the inner end, the volume change rate of the rate-reduced compression chamber (41B) can be rapidly reduced. Thus, the volume change rate of the rate-reduced compression chamber (41B) can be sufficiently reduced until right after the beginning of the discharge phase, i.e., until the rate-reduced compression chamber (41B) comes into the state in which over-compression is likely to occur. As a result, the over-compression loss can be sufficiently reduced.

According to the third aspect of the invention, the involute curves to the base circles having different diameters can be smoothly connected together, and therefore the modified involute curve can be easily formed.

According to the fourth aspect of the invention, the configuration is employed, in which the change in volume change rate is completed when the eccentric rotation angle of the orbiting scroll (36) falls within a range of plus or minus 90 degrees of the discharge start angle. As a result, it can be ensured that over-compression is reduced, and a great suction volume can be ensured.

According to the fifth aspect of the invention, since the wraps (34, 38) of the fixed scroll (31) and the orbiting scroll (36) form the inner compression chamber (41B) as the rate-reduced compression chamber where the volume change rate thereof is reduced in the middle of the compression phase, the over-compression loss in the inner compression chamber (41B) in which over-compression is more likely to occur as compared to the compression chamber formed outside the orbiting scroll (36) can be reduced.

According to the sixth aspect of the invention, the plurality of arc-shaped parts (34A-34E, 38A-38D) continuing each other such that the arc radius decreases form each wrap (34, 38) of the fixed scroll (31) and the orbiting scroll (36), and some (34C, 34E, 38B, 38D) of the arc-shaped parts (34A-34E, 38A-38D) each have the changing thickness. Thus, the wraps (34, 38) configured to reduce the volume change rate of the compression chambers (41A, 41B) in the middle of the compression phase can be easily formed.

BRIEF DESCRIPTION OF THE DRAWINGS

FIGS. 4(A) and 4(B) are plan views illustrating typical wraps. FIG. 4(C) is a plan view illustrating a modified wrap.

DESCRIPTION OF EMBODIMENTS

Embodiments of the present disclosure will be described in detail below with reference to drawings.

First Embodiment of the Invention

A scroll compressor (10) of the present embodiment is connected to a refrigerant circuit of a refrigerating apparatus. That is, in the refrigerating apparatus, refrigerant (e.g., carbon dioxide) compressed in the scroll compressor (10) circulates in the refrigerant circuit to perform a vapor compression refrigeration cycle.

Figure 1:
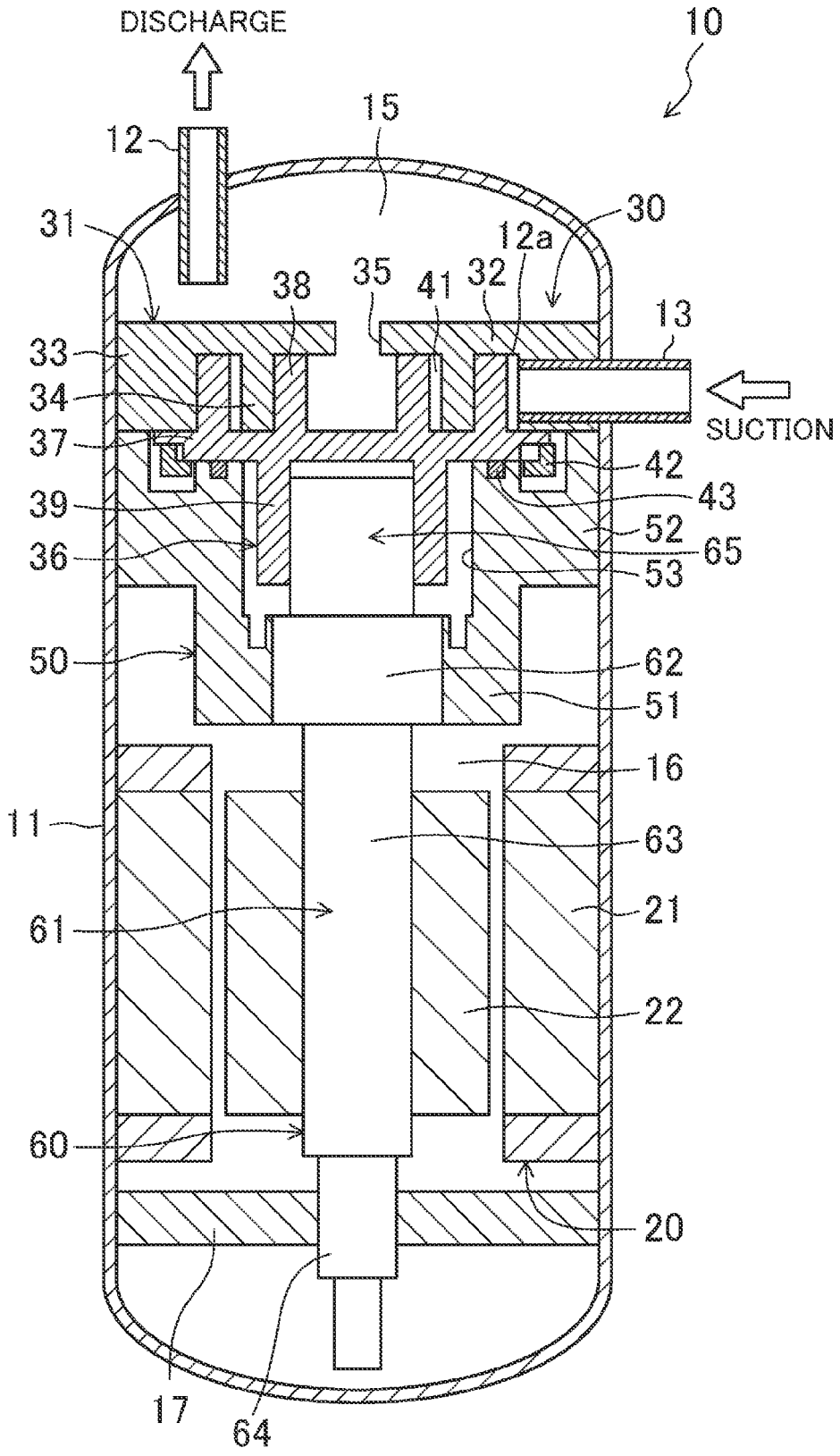
FIG. 1 is a schematic longitudinal sectional view illustrating a configuration of a scroll compressor of a first embodiment.

Referring to FIG. 1, the scroll compressor (10) includes a casing (11) in which an electric motor (20) and a compression mechanism (30) are housed. The casing (11) is formed in an elongated cylindrical shape, and forms a hermetic dome.

The electric motor (20) serves as a drive mechanism configured to rotate a drive shaft (60) to drive the compression mechanism (30). The electric motor (20) includes a stator (21) fixed to the casing (11), and a rotor (22) disposed inside the stator (21). The rotor (22) is fixed to the drive shaft (60) penetrating the rotor (22).

A suction pipe (13) is fixed so as to penetrate an upper part of a body of the casing (11), and a discharge pipe (12) is fixed so as to penetrate a top part of the casing (11). Although not shown in the figure, a bottom part of the casing (11) serves as an oil sump configured to store lubrication oil.

A housing (50) positioned above the electric motor (20) is fixed to the casing (11), and the compression mechanism (30) is provided above the housing (50). An outlet end of the suction pipe (13) is connected to a suction port (12*a*) of the compression mechanism (30), and an inlet end of the discharge pipe (12) opens to an upper space (15) which will be described later.

The drive shaft (60) is disposed along the casing (11) so as to extend in a longitudinal direction of the casing (ii), and includes a main shaft part (61) and an eccentric shaft part (65) formed at an upper end of the main shaft part (61). The main shaft part (61) includes a medium diameter part (63) fixed to the rotor (22) of the electric motor (20), a large diameter part (62) formed above the medium diameter part (63) and supported by an upper bearing (51) of the housing (50), and a small diameter part (64) formed below the medium diameter part (63) and supported by a lower hearing (17). The center of the eccentric shaft part (65) is eccentric to the center of the main shaft part (61) by a predetermined amount. Such an eccentricity amount of the eccentric shaft part (65) corresponds to the revolution radius of an orbiting scroll (36) which will be described later.

The compression mechanism (30) includes a fixed scroll (31) fixed to an upper surface of the housing (50), and the orbiting scroll (36) engaged with the fixed scroll (31). The orbiting scroll (36) is disposed between the fixed scroll (31) and the housing (50), and is placed inside the housing (50).

A circular part (52) is formed in an outer circumferential part of the housing (50). The housing (50) is formed in such a recessed dish shape that a recess (53) is formed in an upper center part of the housing (50). Part of the housing (50) below the recess (53) serves as the upper bearing (51). The housing (50) is press-fitted into the casing (11), and an inner circumferential surface of the casing (11) and an outer circumferential surface of the circular part (52) of the housing (50) hermetically contact with each other across the entire circumference thereof. The housing (50) divides the inside of the casing (11) into the upper space (15) in which the compression mechanism (30) is housed and a lower space (16) in which the electric motor (20) is housed. In the lower space (16), the lower bearing (17) for the main shaft part (61) is provided below the electric motor (20). The lower bearing (17) is fixed to the inner circumferential surface of the casing (11).

The fixed scroll (31) serves as a fixed member fixed to the housing (50). The fixed scroll (31) includes an end plate (32), an outer edge part (33) formed so as to continue to the outer circumference of the end plate (32), and a fixed wrap (34) standing on a front surface (i.e., a surface on a lower side as viewed in FIG. 1) of the end plate (32) inside the outer edge part (33). The end plate (32) is formed in a substantially discoid shape. The outer edge part (33) is formed so as to downwardly protrude from the end plate (32). The fixed wrap (34) is formed in a spiral shape, and is formed integrally with the outer edge part (33) at an outer end part of the fixed wrap (34) positioned outermost thereof (see FIG. 2). That is, in the fixed scroll (31), an inner surface of the outer edge part (33) continues to an inner surface (34*a*) of the fixed wrap (34). The specific shape of the fixed wrap (34) will be described later.

The orbiting scroll (36) serves as a movable member eccentrically rotating with respect to the fixed scroll (31). The orbiting scroll (36) includes an end plate (37), an orbiting wrap (38) standing on a front surface (i.e., a surface on an upper side as viewed in FIG. 1) of the end plate (37), and a cylindrical boss part (39) formed at a center part of the end plate (37) on a rear surface thereof. The orbiting wrap (38) is formed in a spiral shape (see FIG. 2). The boss part (39) is housed in the recess (53) of the housing (50). The eccentric shaft part (65) of the drive shaft (60) is inserted into the boss part (39). Thus, the orbiting scroll (36) is connected to the electric motor (20) through the drive shaft (60). The boss part (39) also serves as a bearing of the eccentric shaft part (65) of the drive shaft (60).

The fixed scroll (31) and the orbiting scroll (36) of the compression mechanism (30) are arranged such that the front surfaces of the end plates (32, 37) face each other and that the wraps (34, 38) are engaged with each other. The scrolls (31, 36) are arranged as described above to divide the compression mechanism (30) into an outer compression chamber (41A) positioned outside the orbiting wrap (38) and an inner compression chamber (41B) positioned inside the orbiting wrap (38). That is, the outer compression chamber (41A) is formed between an outer surface (38*a*) of the orbiting wrap (38) and the inner surface (34*a*) of the fixed wrap (34), and the inner compression chamber (41B) is formed between an inner surface (38*b*) of the orbiting wrap (38) and an outer surface (34*b*) of the fixed wrap (34).

The suction port (12*a*) (see FIG. 1 and not shown in FIG. 2) is formed in the outer edge part (33) of the fixed scroll (31). The suction pipe (13) is connected to the suction port (12*a*), and the suction port (12*a*) is positioned in the vicinity of an outer end part of the fixed 115 wrap (34) so as to communicate with a low-pressure chamber. A discharge port (35) is formed at the center of the end plate (32) of the fixed scroll (31). The discharge port (35) opens to the upper space (15). Thus, the upper space (15) is in high-pressure atmosphere corresponding to the pressure of refrigerant discharged from the compression mechanism (30).

A seal ring (43) is provided at the upper surface of the circular part (52) of the housing (50). The recess (53) is hermetically separated by the seal ring (43). An Oldham's coupling (42) configured to prevent the orbiting scroll (36) from turning on the axis thereof is provided on the housing (50). The Oldham's coupling (42) is provided on the upper surface of the circular part (52) of the housing (50), and is slidably fitted onto the end plate (37) of the orbiting scroll (36) and the housing (50).

Shape of Fixed Wrap and Orbiting Wrap

Figure 2:
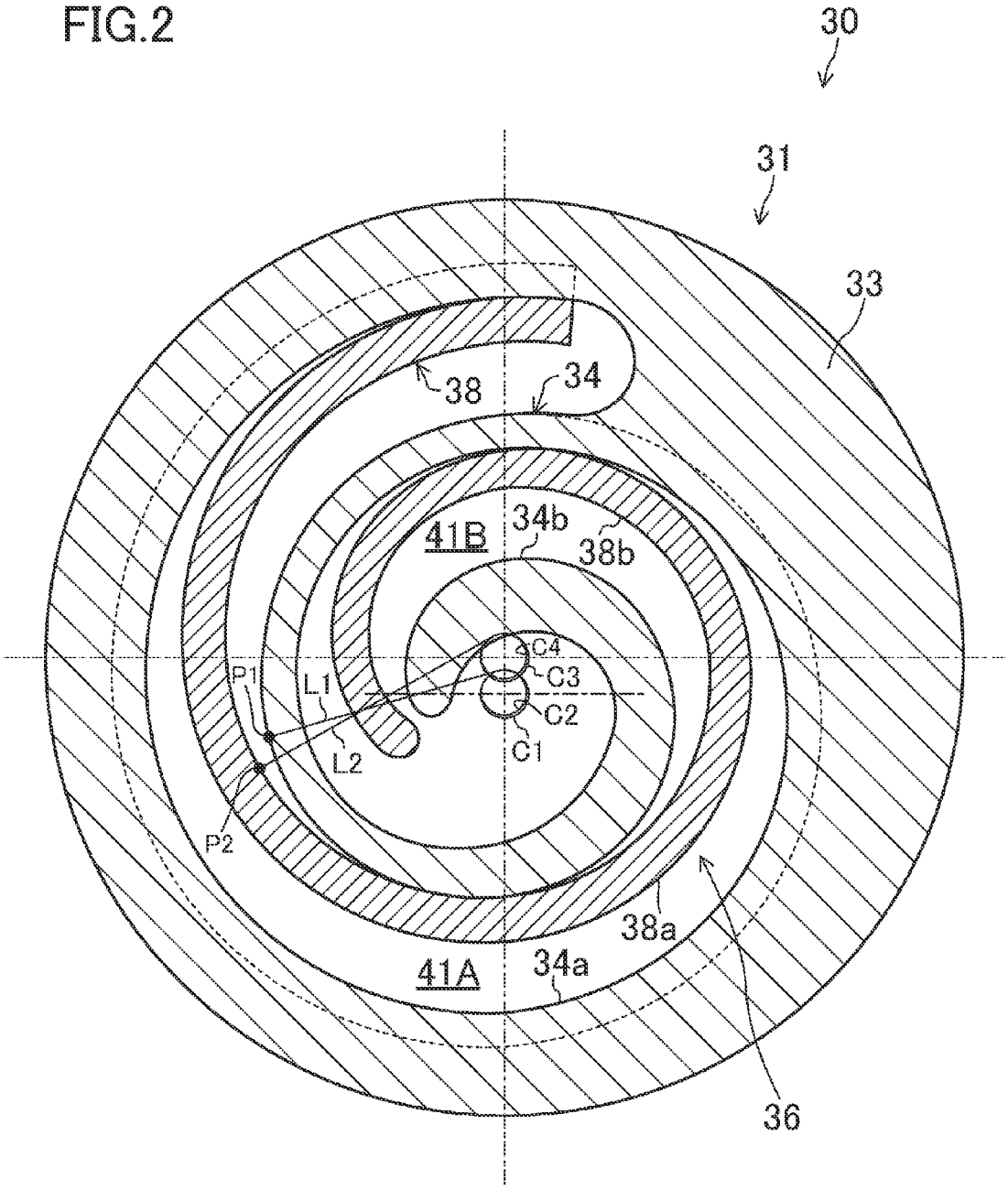
FIG. 2 is a cross-sectional view illustrating a main part of a compression mechanism of the first embodiment.

Referring to FIG. 2, the fixed wrap (34) and the orbiting wrap (38) are each formed in an involute curve shape. Moreover, the fixed wrap (34) and the orbiting wrap (38) each serve as a modified wrap formed in such a shape that the inner compression chamber (41B) serves as a rate-reduced compression chamber where a volume change rate is reduced in the middle of a compression phase.

Figure 3:
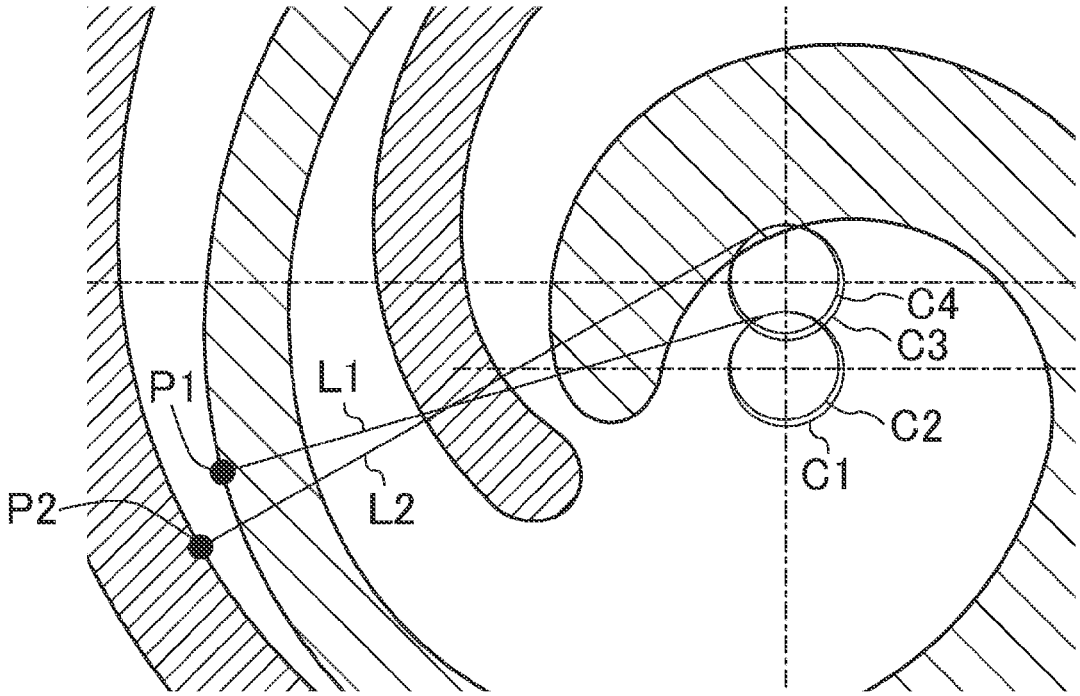
FIG. 3 is an enlarged partial vie of FIG. 2.

Specifically, in the fixed wrap (34), the outer surface (34*h*) facing the inner compression chamber (41B) has an outer part in the shape of an involute curve to a first base circle (C1) having a radius r1, and an inner part in the shape of an involute curve to a second base circle (C2) having a radius r2 (<r1). That is, the outer surface (34*b*) of the fixed wrap (34) is formed in such a modified involute curve shape that the base circle radius decreases from the radius r1 to the radius r2 at a change point (P1) positioned on the way from an outer end to an inner end. Moreover, in the fixed wrap (34), the inner surface (34*a*) facing the outer compression chamber (41A) is formed in the shape of the involute curve to the first base circle (C1). That is, the inner surface (34*a*) of the fixed wrap (34) is formed in such an involute curve shape that the base circle radius does not change between the outer end and the inner end. Further, the fixed wrap (34) is configured such that both of the base circle of the involute curve on an outer end side relative to the change point (P1) and the base circle of the involute curve on an inner end side relative to the change point (P1), i.e., the first base circle (C1) and the second base circle (C2), have the same tangent line L1 passing through the change point (P1) at which the radius of the base circle of the modified involute curve defining the shape of the outer surface (34*b*) changes (see FIG. 3).

On the other hand, in the orbiting wrap (38), the inner surface (38*b*) facing the inner compression chamber (41B) has an outer part in the shape of an involute curve to a third base circle (C3) having a radius r3, and an inner part in the shape of an involute curve to a fourth base circle (C4) having a radius r4 (<r3). That is, the inner surface (38*b*) of the orbiting wrap (38) is formed in such a modified involute curve shape that the base circle radius decreases from the radius r3 to the radius r4 at a change point (P2) positioned on the way from an outer end to an inner end. Moreover, in the orbiting wrap (38), the outer surface (38*a*) facing the outer compression chamber (41A) is formed in the shape of the involute curve to the third base circle (C3). That is, the outer surface (38*a*) of the orbiting wrap (38) is formed in such an involute curve shape that the base circle radius does not change between the outer end and the inner end. Further, the orbiting wrap (38) is configured such that both of the base circle of the involute curve on the outer end side relative to the change point (P2) and the base circle of the involute curve on the outer end side relative to the change point (P2), i.e., the third base circle (C3) and the fourth base circle (C4), have the same tangent line L2 passing through the change point (P2) at which the radius of the base circle of the modified involute curve defining the shape of the inner surface (38*b*) changes (see FIG. 3).

As described above, in the first embodiment, the outer surface (34*b*) of the fixed wrap (34) facing the inner compression chamber (41B) and the inner surface (38*b*) of the orbiting wrap (38) facing the inner compression chamber (41B) are formed in such a modified involute curve shape that the base circle radius decreases in a stepwise manner on the way from the outer end to the inner end. Since the side surfaces of the fixed wrap (34) and the orbiting wrap (38) facing at least one of the compression chambers (41A, 41B) is formed in such a modified involute curve shape that the base circle radius decreases in the stepwise manner on the way from the outer end to the inner end, the rate of change in volume of the at least one of the compression chambers (41A, 41B) can be reduced in the middle of the compression phase. A reason for such reduction will be described below with reference to FIGS. 4(A)-4(C).

Figure 4A:
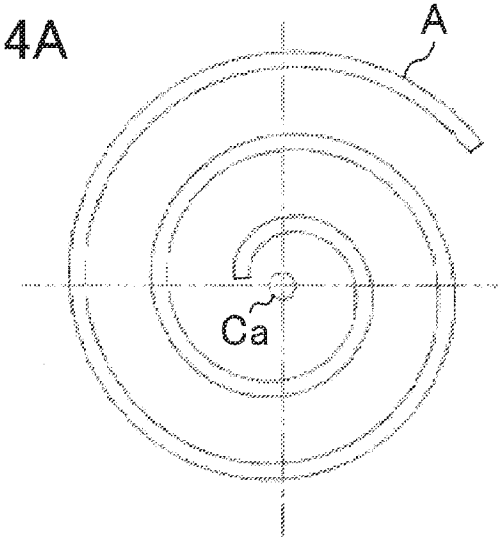
FIGS. 4(A)-4(C) are views illustrating a relationship between a wrap shape and a volume change rate.
Figure 4B:
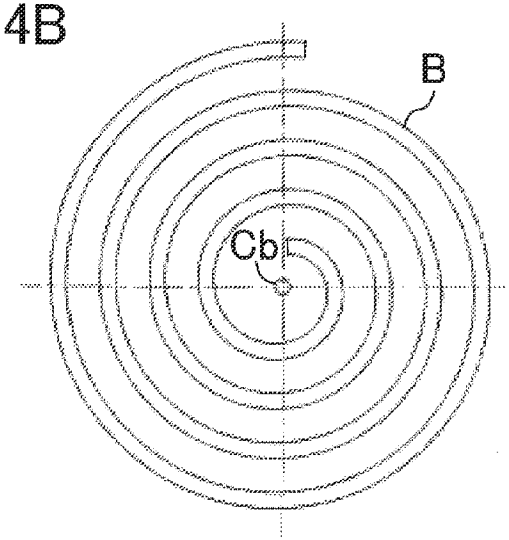
Figure 4C:
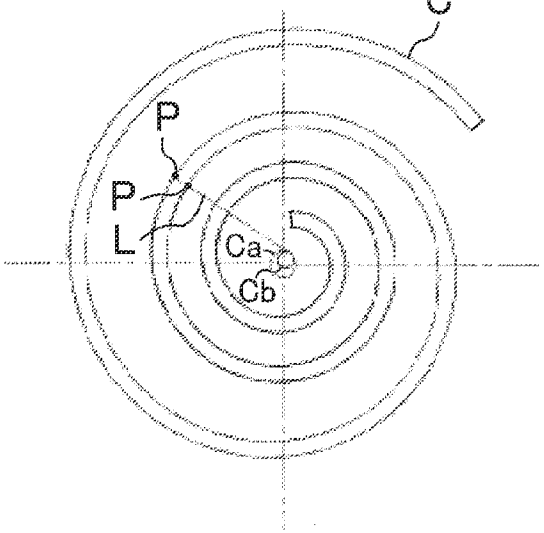
Figure 5A:
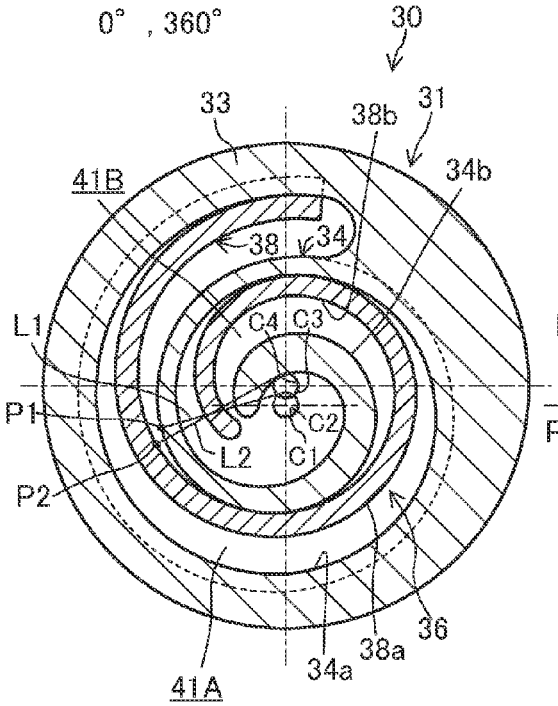
FIGS. 5(A)-5(D) are cross-sectional views illustrating operation of the compression mechanism of the first embodiment.
Figure 5B:
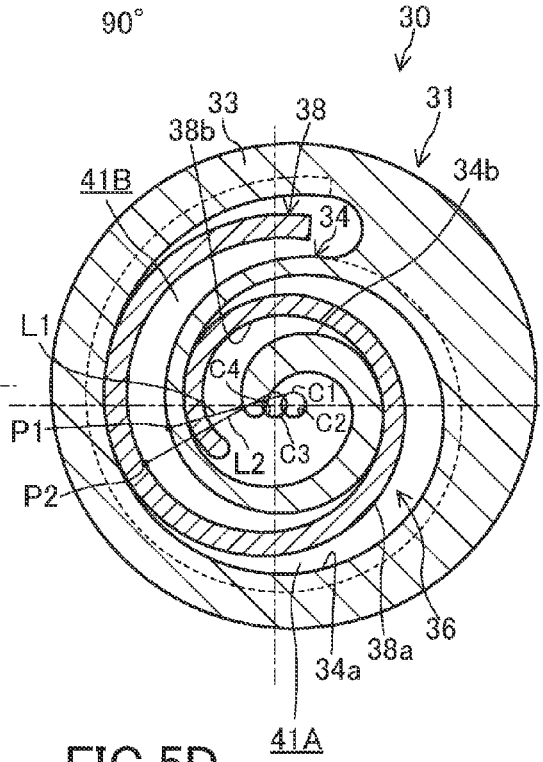
Figure 5C:
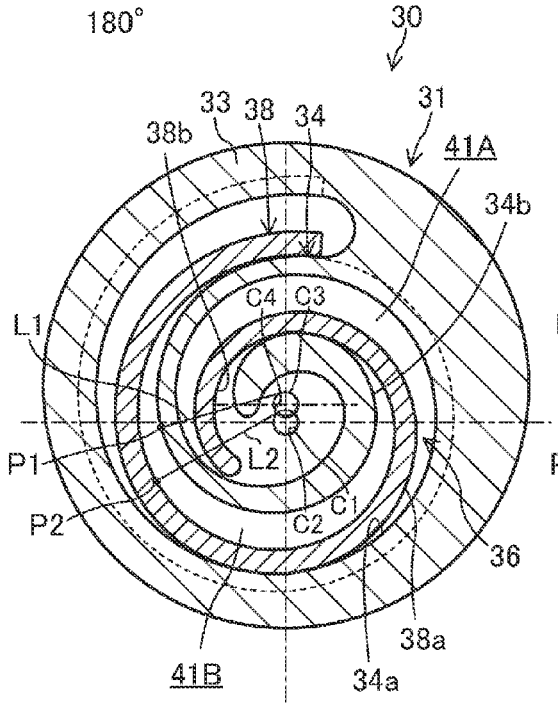
Figure 5D:
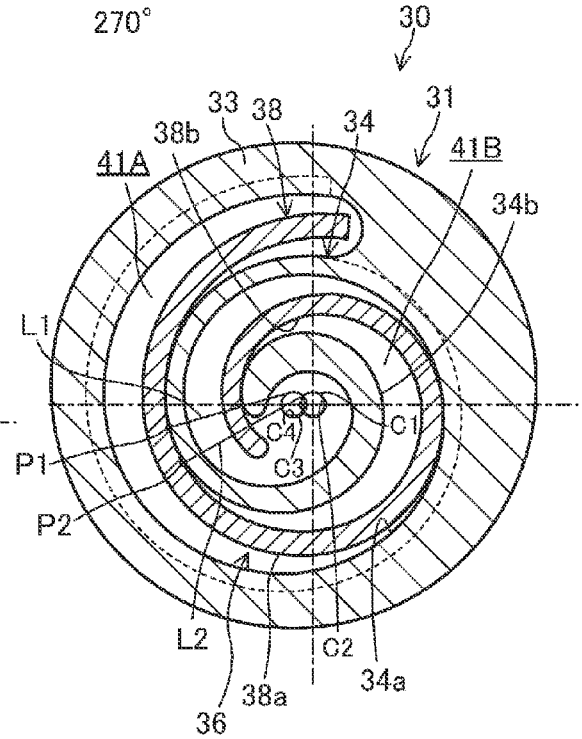

FIG. 4(A) illustrates a wrap (A) with outer and inner surfaces each formed in the shape of an involute curve to a base circle (Ca) having a radius ra. FIG. 4(B) illustrates a wrap (B) with outer and inner surfaces each formed in the shape of an involute curve to a base circle (Cb) having a radius rb (<ra). FIG. 4(C) illustrates a wrap (C) formed in a composite shape of part of the wrap (A) and part of the wrap (B).

Specifically, in the wrap (C) illustrated in FIG. 4(C), an outer part extending from an outer end to a change point P is formed in the shape of the involute curve to the base circle (Ca) as in the wrap (A), and an inner part extending from the change point P to an inner end is formed in the shape of the involute curve to the base circle (Cb) having the radius rb (<ra) as the wrap (B). That is, in the wrap (C), outer and inner surfaces thereof are formed in such a modified involute curve shape that the base circle radius decreases from the radius ra to radius rb on the way from the outer end to the inner end. Moreover, the wrap (C) is configured such that both of the base circle of the involute curve on the outer end side relative to the change point P and the base circle of the involute curve on the inner end side relative to the change point P i.e., the base circle (Ca) and the base circle (Cb), have the same tangent line L passing through the change point P at which the radius of the base circle of the modified involute curve defining the shape of the outer and inner surfaces changes.

As will be clearly seen from FIGS. 4(A) and 4(B), a smaller radius of a base circle results, for involute curves having the same radius of curvature at an outer end, in an increase in the number of turns. Thus, the number of turns of the wrap (B) in the shape of the involute curve to the base circle (Cb) having the radius rb (<ra) is higher than the number of turns of the wrap (A) in the shape of the involute curve to the base circle (Ca) having the radius ra. Consequently, the length of the wrap (A) from an outer end to an inner end is shorter than the length of the wrap (B) from an outer end to an inner end. As a result, if the wrap (A) is used, each compression passage formed inside and outside the wrap (A) is shorter than that of the wrap (B), and therefore the rate of change in volume of each compression chamber (i.e., the rate of reduction in volume of each compression chamber) formed inside and outside the wrap (A) is higher than that of the wrap (B). On the other hand, if the wrap (B) is used, the number of turns of the wrap (B) is higher than that of the wrap (A), and therefore a suction volume is, for the involute curves having the same radius of curvature at the outer end, less in the wrap (B) than in the wrap (A).

In the wrap (C) illustrated in FIG. 4(C), the outer part is formed in the shape of the involute curve to the base circle (Ca) as in the wrap (A), and the inner part is formed in the shape of the involute curve to the base circle (Cb) having the radius rb (<ra) as in the wrap (B). That is, the wrap (C) changes, on the way from the outer end to the inner end, the shape thereof from an involute curve shape having a lower number of turns (i.e., the shape of an involute curve to a large base circle) to an involute curve shape having a higher number of turns (i.e., the shape of an involute curve to a small base circle). Suppose that the rate of change in volume of the compression chamber in the case where the wrap (A) is used is "A," and the rate of change in volume of the compression chamber in the case where the wrap (B) is used is "B." If the wrap (C) is used, the rate of change in volume of a compression chamber (i.e., the rate of reduction in volume of the compression chamber) changes from the volume change rate A to the volume change rate B as the orbiting scroll (36) eccentrically rotates. That is, if the wrap (C) is used, the rate of change in volume of the compression chamber (i.e., the rate of reduction in volume of the compression chamber) is reduced in the middle of the compression phase. Since the outer part of the rap (C) is formed in the shape of the involute curve to the base circle (Ca) as in the wrap (A), a greater suction volume can be, as in the case of the wrap (A), ensured in the wrap (C) than in the wrap (B).

FIG. 4(C) illustrates that the inner and outer surfaces of the wrap (C) are both formed in the shape of the modified involute curve. However, if only the inner surface of the wrap (C) is formed in the shape of the modified involute curve, and the outer surface of the wrap (C) is formed in the shape of an involute curve only to a single base circle, only the rate of change in volume of the inner compression chamber of the wrap (C) (i.e., the rate of reduction in volume of the inner compression chamber of the wrap (C)) changes from the volume change rate A to the volume change rate B in the middle of the compression phase. Conversely, if only the outer surface of the wrap (C) is formed in the shape of the modified involute curve, and the inner surface of the the wrap (C) is formed in the shape of an involute curve only to a single base circle, only the rate of change in volume of the outer compression chamber of the wrap (C) (i.e., the rate of reduction in volume of the outer compression chamber of the wrap (C)) changes from the volume change rate A to the volume change rate B in the middle of the compression phase.

Figure 6:
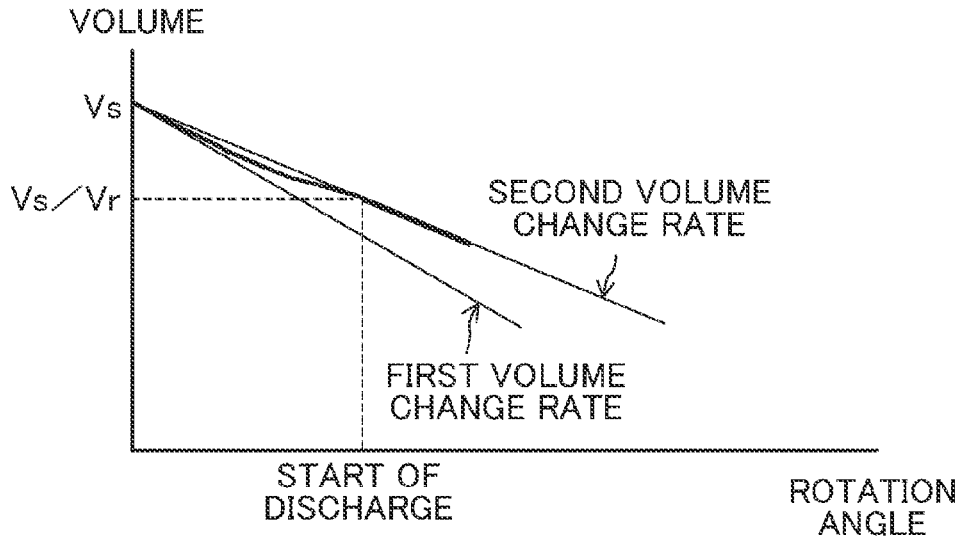
FIG. 6 is a graph illustrating a change in volume change rate of an inner compression chamber of the compression mechanism of the first embodiment.

As described above, in the first embodiment, the outer surface (34*b*) of the fixed wrap (34) facing the inner compression chamber (41B) and the inner surface (38*b*) of the orbiting wrap (38) facing the inner compression chamber (41B) are formed in such a modified involute curve shape that the base circle radius decreases in the stepwise manner on the way from the outer end to the inner end. Thus, the rate of change in volume of the inner compression chamber (41B) changes from a first volume change rate to a second volume change rate lower than the first volume change rate as the orbiting scroll (36) eccentrically rotates (see FIG. 6). Moreover, in the first embodiment, the change point (P1) of the fixed wrap (34) and the change point (P2) of the orbiting wrap (38) are designed such that a change in volume change rate of the inner compression chamber (41B) (i.e., a change from the first volume change rate to the second volume change rate) is completed right after the beginning of a discharge phase of the inner compression chamber (41B). That is, the change point (P1) of the fixed wrap (34) and the change point (P2) of the orbiting wrap (38) are designed to be at an angular position which does not face the inner compression chamber (41B) right after the discharge phase begins. Thus, the rate of change in volume of the inner compression chamber (41B) right after the beginning of the discharge phase is the second volume change rate lower than the first volume change rate.

Operation

As described above, the scroll compressor (10) of the present embodiment is connected to the refrigerant circuit of the refrigerating apparatus. In the refrigerant circuit, refrigerant circulates to perform the vapor compression refrigeration cycle. On this occasion, the scroll compressor (10) sucks low-pressure refrigerant evaporated in an evaporator to compress such refrigerant, and sends the compressed high-pressure refrigerant to a condenser. First, a basic operation of the scroll compressor (10) will be described below.

When the electric motor (20) is started, the orbiting scroll (36) of the compression mechanism (30) is rotatably driven. Since the Oldham's coupling (42) prevents the orbiting scroll (36) from turning on the axis thereof, the orbiting scroll (36) does not turn on the axis thereof, but eccentrically rotates about the center of the drive shaft (60). That is, while the outer edge part (33) of the fixed scroll (31) and the end plate (37) of the orbiting scroll (36) slide against each other, the orbiting scroll (36) eccentrically rotates with respect to the fixed scroll (31). FIGS. 5(A)-5(D) illustrates a change in position of the orbiting scroll (36) every 90 degrees of a rotation angle in association with rotation of the drive shaft (60). The position of the orbiting scroll (36) changes in the order of FIGS. 5(A), 5(B), 5(C), and 5(D).

While each of the outer compression chamber (41A) and the inner compression chamber (41B) communicates with the suction port (12*a*), an suction phase for sucking low-pressure refrigerant through the suction port (12*a*) and the suction pipe (13) is performed. During the suction phase, the volume of the compression chamber (41A, 41B) increases as the orbiting scroll (36) eccentrically rotates, and, accordingly, refrigerant is sucked into the compression chamber (41A, 41B). When the suction port (12*a*) is closed, the suction phase is completed in the compression chamber (41A, 41B). Then, the compression phase for compressing the refrigerant begins. In the outer compression chamber (41A), the suction phase is completed when the rotation angle of the drive shaft (60) is around 0 degree (or 360 degrees), and then the compression phase begins (see FIG. 5(A)). In the inner compression chamber (41B), the suction phase is completed when the rotation angle of the drive shaft (60) is around 180 degrees, and then the compression phase begins (see FIG. 5(C)).

During the compression phase, while the volume of the compression chamber (41A, 41B) decreases with eccentric rotation of the orbiting scroll (36), the compression chamber (41A, 41B) moves toward the center. Meanwhile, the low-pressure gas refrigerant sucked into the compression chamber (41A, 41B) is compressed. In the compression chamber (41A, 41B), the compression stoke is performed until the compression chamber (41A, 41B) communicates with the discharge port (35). When the compression chamber (41A, 41B) and the discharge port (35) come into communication with each other, the discharge phase for discharging the refrigerant through the discharge port (35) begins. In the outer compression chamber (41A), the compression phase is completed when the rotation angle of the drive shaft (60) is around 90 degrees, and then the discharge phase begins (see FIG. 5(B)). In the inner compression chamber (41B), the compression phase is completed when the rotation angle of the drive shaft (60) is around 270 degrees, and then discharge phase begins (see FIG. 5(D)).

During the discharge phase, the volume of the compression chamber (41A, 0.41B) decreases as the orbiting scroll (36) eccentrically rotates, and, accordingly, the high-pressure gas refrigerant compressed in the compression phase is discharged from the compression chamber (41A, 41B) to the upper space (15) through the discharge port (35). The refrigerant discharged to the upper space (15) flows out from the casing (11) through the discharge pipe (12).

In the scroll compressor (10) described above, the cross-sectional area of a passage through which the compression chamber (41A, 41B) and the discharge port (35) communicate with each other is small right after the discharge phase begins. Specifically, since a clearance between an inner end part of the fixed wrap (34) and an inner end part of the orbiting wrap (38) is, referring to, e.g., FIG. 5(A), small right after the discharge phase begins in the inner compression chamber (41B), the cross-sectional area of the passage through which the inner compression chamber (41B) and the discharge port (35) communicate with each other is small. Even in such a state, the volume of the compression chamber (41A, 41B) decreases, as in the compression phase, as the orbiting scroll (36) eccentrically rotates. Thus, although the discharge phase begins, the high-pressure gas refrigerant is further compressed in the compression chamber (41A, 41B). Accordingly, it is likely that the pressure of the refrigerant exceeds a discharge pressure, i.e., over-compression occurs.

However, in the first embodiment, the inner surface (38*b*) of the orbiting wrap (38) facing the inner compression chamber (41B) and the outer surface (34*b*) of the fixed wrap (34) facing the inner compression chamber (41B) are formed in such a modified involute curve shape that the base circle radius decreases at the change point (P2, P1) on the way from the outer end to the inner end. Thus, the inner compression chamber (41B) is configured such that the rate of change in volume of the inner compression chamber (41B) is reduced in the middle of the compression phase.

Figure 7:
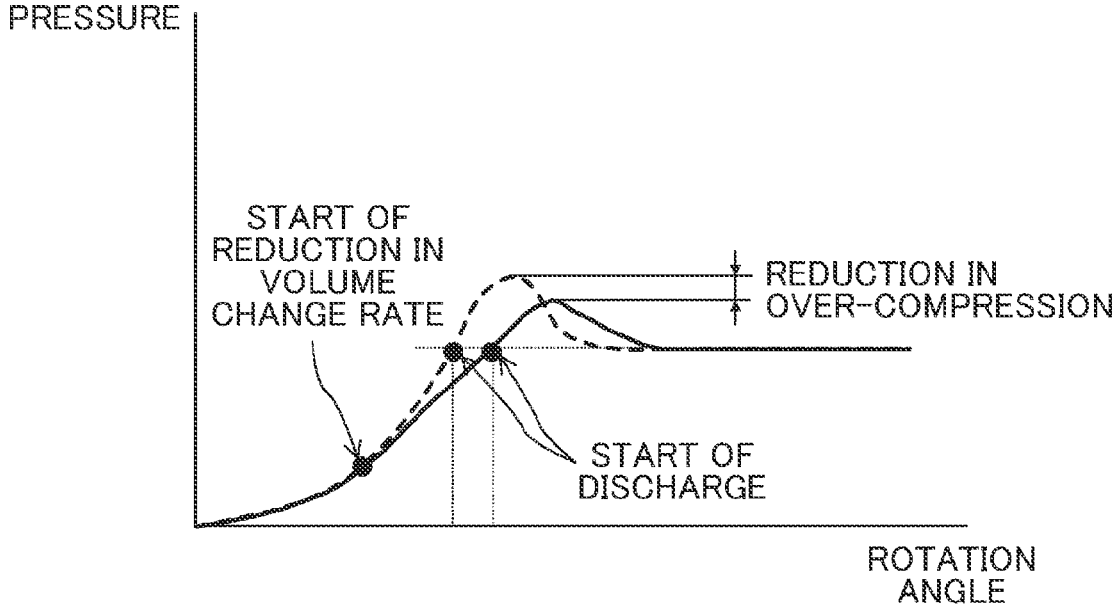
FIG. 7 is a graph illustrating a change its pressure of the inner compression chamber of the compression mechanism of the first embodiment.

Specifically, the rate of change in volume of the inner compression chamber (41B) changes, with eccentric rotation of the orbiting scroll (36), from the first volume change rate to the second volume change rate lower than the first volume change rate. In the first embodiment, right after the discharge phase begins in the inner compression chamber (41B) in such a manner that the fixed wrap (34) and the orbiting wrap (38) are separated from each other at the innermost contact point therebetween, the change in volume change rate of the inner compression chamber (41B) from the first volume change rate to the second volume change rate is completed. As a result, although the cross-sectional area of the passage through which the inner compression chamber (41B) and the discharge port (35) communicate with each other is small right after the beginning of the discharge phase, the rate of change in volume of the inner compression chamber (41B) (i.e., the rate of reduction in volume of the inner compression chamber (41B)) is the relatively-low second volume change rate. As indicated by a solid line illustrated in FIG. 7, the degree of over-compression causing the pressure of refrigerant to exceed the discharge pressure due to the high volume change rate of the inner compression chamber (41B) is, right after the beginning of the discharge phase, lower as compared to the case (see a dashed line illustrated in FIG. 7) where the modified wrap is not used. That is, an over-compression loss is reduced as compared to the case (see the dashed line illustrated in FIG. 7) where the modified wrap is not used.

Advantages of First Embodiment

As described above, according to the first embodiment, the fixed wrap (34) and the orbiting wrap (38) are formed in such a shape that the inner compression chamber (41B) serves as the rate-reduced compression chamber where the volume change rate is reduced in the middle of the compression phase. Thus, although the cross-sectional area of the communication passage between the compression chamber and the discharge port through which fluid is discharged is small in the scroll compressor (10) right after the beginning of the discharge phase, the rate of change in volume of the inner compression chamber (41B) is changed to a relatively-low value upon completion of the compression phase, and therefore over-compression of refrigerant in the inner compression chamber (41B) right after the beginning of the discharge phase can be reduced. Accordingly, the over-compression loss can be reduced. Moreover, the fixed wrap (34) and the orbiting wrap (38) are configured such that the rate of change in volume of the inner compression chamber (41B) is reduced in the middle of the compression phase, the over-compression loss can be reduced without increasing the size of the scroll compressor (10).

For involute curves having the same radius of curvature at an outer end, a smaller radius of a base circle results in an increase in the number of turns, and therefore results in an increase in length of the involute curve. Thus, if a wrap formed in the shape of an involute curve to a base circle having a small diameter is used, a refrigerant compression passage is extended, and the rate of change in volume of a compression chamber is reduced.

According to the first embodiment, since the side surfaces (34*b*, 38*b*) of the fixed wrap (34) and the orbiting wrap (38) facing the inner compression chamber (41B) are formed in such a modified involute curve shape that the base circle radius decreases in the stepwise manner on the way from the outer end to the inner end, the modified wrap configured to reduce the rate of change in volume of the inner compression chamber (41B) in the middle of the compression phase can be easily formed. Moreover, since the side surfaces (34*b*, 38*b*) of the fixed wrap (34) and the orbiting wrap (38) facing the inner compression chamber (41B) are formed in such a modified involute curve shape that the base circle radius decreases in the stepwise manner, the rate of change in volume of the inner compression chamber (41B) can be rapidly reduced. Thus, the rate of change in volume of the inner compression chamber (41B) can be sufficiently reduced until right after the beginning of the discharge phase, i.e., until the inner compression chamber (41B) comes into the state in which over-compression is likely to occur. As a result, the over-compression loss can be sufficiently reduced.

According to the first embodiment, the base circle of the involute curve on the outer end side relative to the change point and the base circle of the involute curve on the inner end side relative to the change point are not arranged so as to be concentric to each other, but the small-diameter base circle is inscribed in the large-diameter base circle. The base circle radius changes on the tangent line to such an inscription point. That is, the involute curve to the large-diameter base circle and the involute curve to the small-diameter base circle are connected together on the foregoing tangent line. Since the involute curves to the base circles having different diameters are connected together as described above, the two types of involute curves can be smoothly connected together, and the modified involute curve can be easily formed.

In the first embodiment, the rate of change in volume of the inner compression chamber (41B) changes from the first volume change rate to the second volume change rate as the orbiting scroll (36) eccentrically rotates. Such a change in volume change rate is completed when the eccentric rotation angle of the orbiting scroll (36) falls within a range of plus or minus 90 degrees of a discharge start angle at which the discharge phase begins in the inner compression chamber (41B). More specifically, in the first embodiment, the change in volume change rate is completed right after the discharge phase begins in the inner compression chamber (41B).

As described above, in the scroll compressor (10), the cross-sectional area of the communication passage between the compression chamber (41A, 41B) and the discharge (35) through which refrigerant is discharged is small after the discharge phase begins and before the orbiting scroll (36) rotates about 90 degrees. For such a reason, the change in volume change rate of the inner compression chamber (41B) is preferably completed before the discharge phase begins in the inner compression chamber (41B), or is, even after the beginning of the discharge phase, preferably completed until the orbiting scroll (36) rotates about 90 degrees. However, if the change in volume change rate of the inner compression chamber (41B) is completed, e.g., right after the beginning of the compression phase, there is a possibility that a desired compression ratio cannot be ensured due to a reduced suction volume. Thus, the foregoing configuration is employed, in which the change in volume change rate is completed when the eccentric rotation angle of the orbiting scroll (36) falls within a range of plus or minus 90 degrees of the discharge start angle. As a result, it can be ensured that over-compression is reduced, and a great suction volume can be ensured.

In the first embodiment, the wraps (34, 38) of the fixed scroll (31) and the orbiting scroll (36) are each formed in an asymmetric shape. In such a case, since the compression passage is shorter in the inner compression chamber (41B) formed inside the wrap of the orbiting scroll (36) than in the outer compression chamber (41A) formed outside the wrap of the orbiting scroll (36), the volume change rate is higher in the inner compression chamber (41B) than in the outer compression chamber (41A), and the volume change rate increases as the orbiting scroll (36) eccentrically rotates. For such a reason, over-compression is more likely to occur in the inner compression chamber (41B) than in the outer compression chamber (41A), and the over-compression loss is greater in the inner compression chamber (41B) than the outer compression chamber (41A).

However, according to the first embodiment, since the fixed wrap (34) and the orbiting wrap (38) form the inner compression chamber (41B) as the rate-reduced compression chamber where the volume change rate is reduced in the middle of the compression phase, the over-compression loss in the inner compression chamber (41B) in which over-compression is, as compared to the outer compression chamber (41A), more likely to occur due to a higher volume change rate can be reduced.

In the first embodiment, although the outer surface (34*b*) of the fixed wrap (34) facing the inner compression chamber (41B) and the inner surface (38*b*) of the orbiting wrap (38) facing the inner compression chamber (41B) are formed in the modified involute curve shape, the inner surface (34*a*) of the fixed wrap (34) facing the outer compression chamber (41A) and the outer surface (38*a*) of the orbiting wrap (38) facing the outer compression chamber (41A) may be formed in the modified involute curve shape. In such a case, the outer compression chamber (41A) can be configured such that the volume change rate thereof is reduced in the middle of the compression phase. Alternatively, the side surfaces (34*a*, 34*b*, 38*a*, 38*b*) of the fixed wrap (34) and the orbiting wrap (38) may be formed in the modified involute curve shape such that the rate of change in volume of both of the inner compression chamber (41B) and the outer compression chamber (41A) is reduced in the middle of the compression phase.

In the first embodiment, the fixed wrap (34) of the fixed scroll (31) and the orbiting wrap (38) of the orbiting scroll (36) are each formed in a so-called asymmetric spiral pattern, i.e., in an asymmetric shape. However, in the present disclosure, the fixed wrap (34) of the fixed scroll (31) and the orbiting wrap (38) of the orbiting scroll (36) may be each formed in a so-called symmetric spiral pattern, i.e., in a symmetric shape.

Second Embodiment of the Invention

In a second embodiment, the shape of the fixed wrap (34) and the orbiting wrap (38) of the scroll compressor (10) of the first embodiment is changed. Since other configuration of the second embodiment is the same as that of the first embodiment, only the shape of the fixed wrap (34) and the orbiting wrap (38) will be described below.

Shape of Fixed Wrap and Orbiting Wrap

Figure 8:
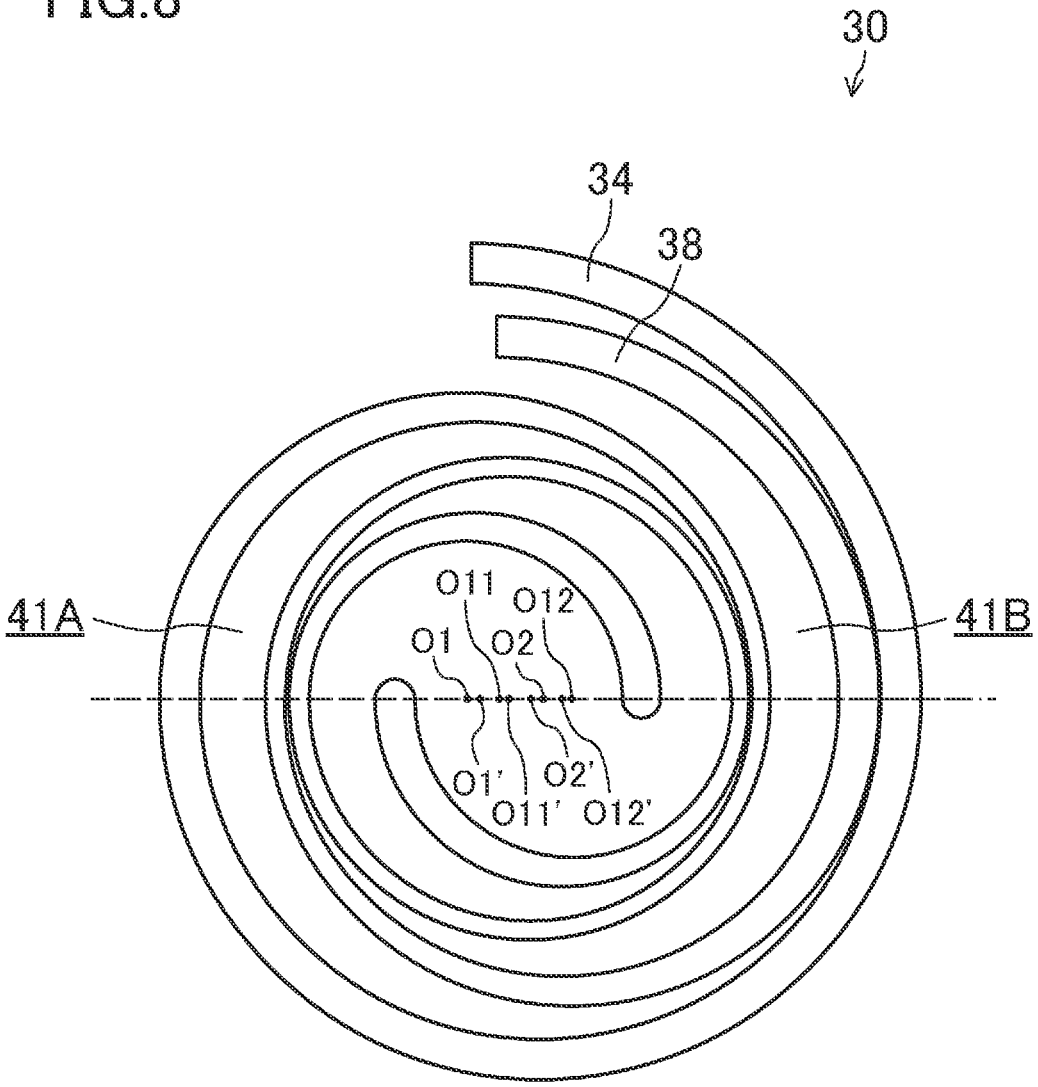
FIG. 8 is a cross-sectional view illustrating a main part of a compression mechanism of a second embodiment.

Referring to FIG. 8, a plurality of arc-shaped parts (34A-34E, 38A-38D) continuing each other such that an arc radius decreases from an outer end to an inner end form each of a fixed wrap (34) and an orbiting wrap (38). Moreover, each of the fixed wrap (34) and the orbiting wrap (38) is a modified wrap of the present disclosure in such a shape that the rate of change in volume of an inner compression chamber (41B) and an outer compression chamber (41A) is reduced in the middle of a compression phase.

Figure 9B:
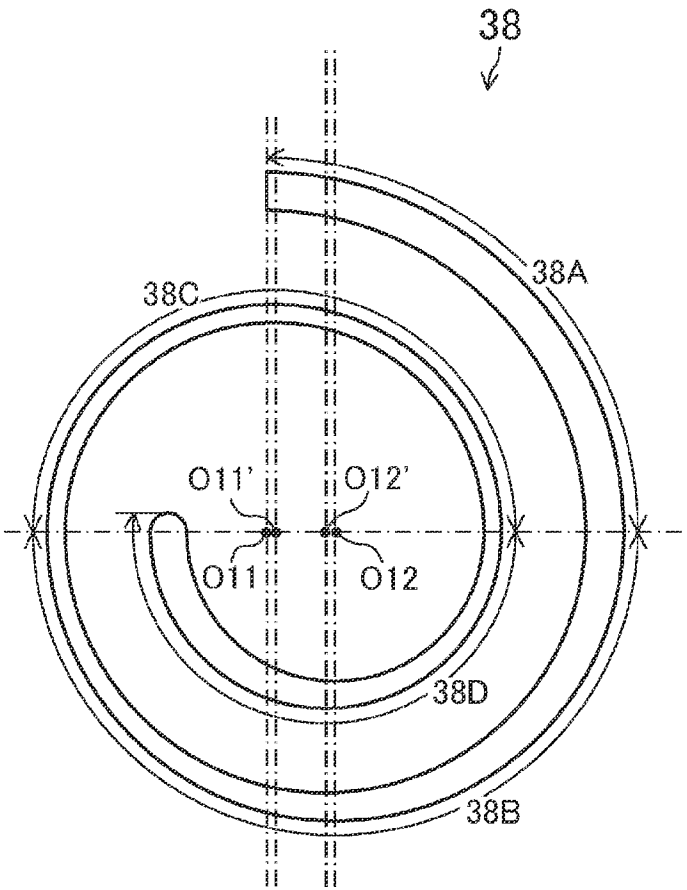
FIG. 9(B) is a cross-sectional view illustrating an orbiting wrap of the second embodiment.
Figure 9A:
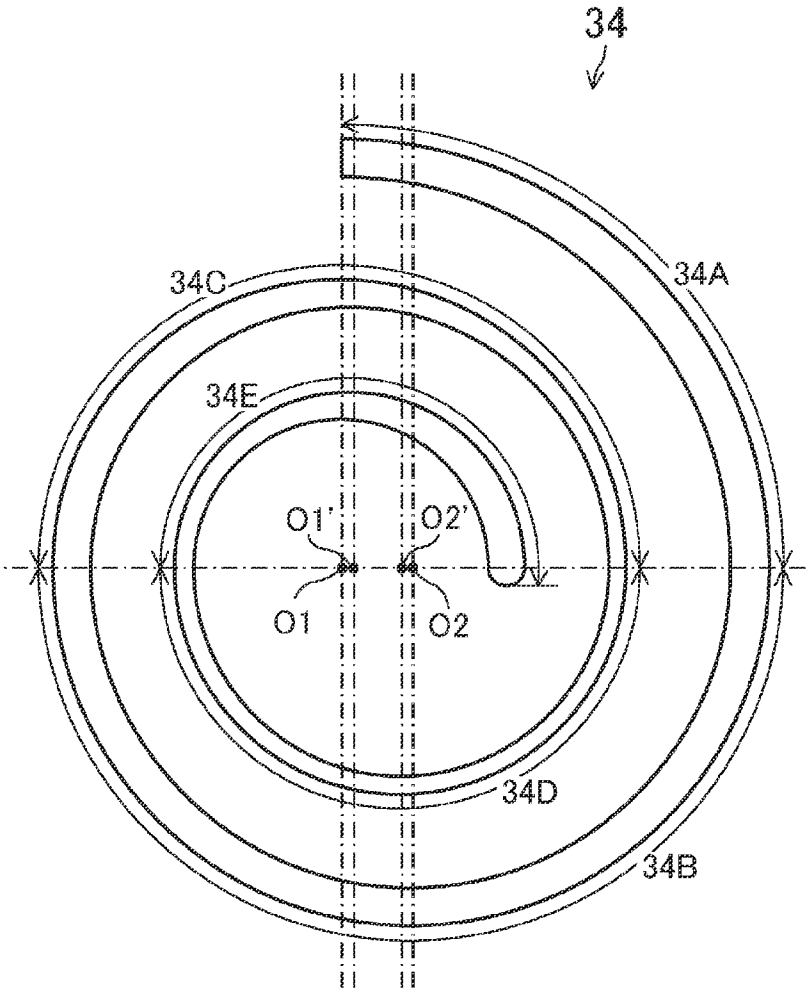
FIG. 9(A) is a cross-sectional view illustrating a fixed wrap of the second embodiment.

Specifically, the first to fifth arc-shaped parts (34A-34E) continuing each other from the outer end to the inner end forms the fixed wrap (34) as illustrated in FIG. 9(A). The first arc-shaped part (34A) has outer and inner arc-shaped surfaces each formed about a point O1. The second arc-shaped part (34B) has outer and inner arc-shaped surfaces each formed about a point O2. The third arc-shaped part (34C) has an outer arc-shaped surface formed about the point O1, and has an inner arc-shaped surface formed about a point O1'. The fourth arc-shaped part (34D) has outer and inner arc-shaped surfaces each formed about a point O2'. The fifth arc-shaped part (34E) has an outer arc-shaped surface formed about the point O1', and has an inner arc-shaped surface formed about the point O1.

Of the first to fifth arc-shaped parts (34A-34E) of the fixed wrap (34), the first arc-shaped part (34A), the second arc-shaped part (34B), and the fourth arc-shaped part (34D) each having the outer and inner arc-shaped surfaces formed about the same center are, as described above, formed so as to have a constant thickness from the outer end to the inner end. On the other hand, the third arc-shaped part (34C) and the fifth arc-shaped part (34E) each having the outer and inner arc-shaped surfaces formed about the different centers are formed such that the thickness thereof changes from the outer end to the inner end. Specifically, the thickness of the third arc-shaped part (34C) decreases from the outer end to the inner end, whereas the thickness of the fifth arc-shaped part (34E) increases from the outer 115 end to the inner end.

Referring to FIG. 9(B), the first to fourth arc-shaped parts (38A-38D) continuing each other from the outer end to the inner end form the orbiting wrap (38). The first arc-shaped part (38A) has outer and inner arc-shaped surfaces each formed about a point O11. The second arc-shaped part (38B) has an outer arc-shaped surface formed about a point O12, and has an inner arc-shaped surface formed about a point O12'. The third arc-shaped part (38C) has outer and inner arc-shaped surfaces each formed about a point O11'. The fourth arc-shaped part (38D) has an outer arc-shaped surface formed about the point O12', and has an inner arc-shaped surface formed about the point O12.

Of the first to fourth arc-shaped parts (38A-38D) of the fixed wrap (34), the first arc-shaped part (38A) and the third arc-shaped part (38C) each having the outer and inner arc-shaped surfaces formed about the same center are, as described above, formed so as to have a constant thickness from the outer end to the inner end. On the other hand, the second arc-shaped part (38B) and the fourth arc-shaped part (38D) each having the outer and inner arc-shaped surfaces formed about the different centers are formed such that the thickness thereof changes from the outer end to the inner end. Specifically, the thickness of the second arc-shaped part (38B) decreases from the outer end to the inner end, whereas the thickness of the fourth arc-shaped part (38D) increases from the outer end to the inner end.

As described above, in the second embodiment, each of the fixed wrap (34) and the orbiting wrap (38) has the parts formed such that the thickness thereof changes from the outer end to the inner end.

Figure 10:
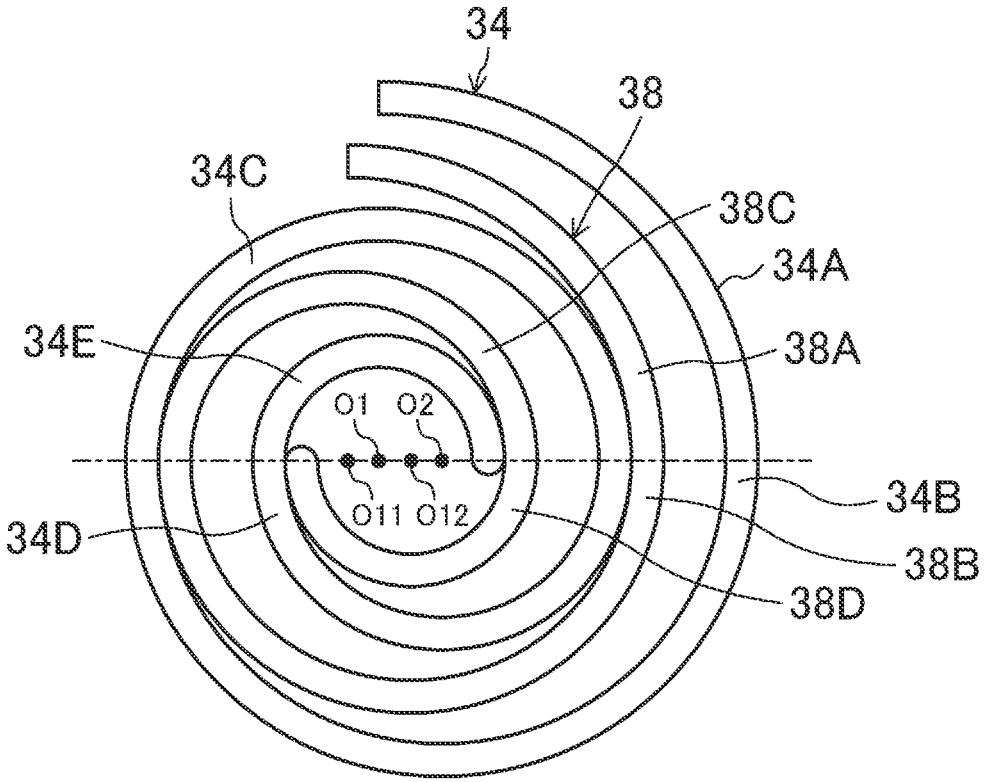
FIG. 10 is a cross-sectional view illustrating a modified fixed wrap and a modified orbiting wrap each having a constant thickness in the second embodiment.

If each arc-shaped part (34A-34E, 38A-38D) of the fixed wrap (34) and the orbiting wrap (38) has a constant thickness as illustrated in FIG. 10, a volume change rate is constant in an outer compression chamber (41A) and the inner compression chamber (41B). In such a case, the first arc-shaped part (34A), the third arc-shaped part (34C), and the fifth arc-shaped part (34E) of the fixed wrap (34) each have outer and inner arc-shaped surfaces formed about the point O1, and the second arc-shaped part (34B) and the fourth arc-shaped part (34D) of the fixed wrap (34) each have outer and inner arc-shaped surfaces formed about the point O2. On the other hand, the first arc-shaped part (38A) and the third arc-shaped part (38C) of the orbiting wrap (38) each have outer and inner arc-shaped surfaces formed about the point O11, and the second arc-shaped part (38B) and the fourth arc-shaped part (38D) of the orbiting wrap (38) each have outer and inner arc-shaped surfaces formed about the point O12.

According to the second embodiment, in the fixed wrap (34), the inner arc-shaped surface of the third arc-shaped part (34C) and the inner arc-shaped surface of the fifth arc-shaped part (34E) are, referring to FIG. 9(A), formed not about the points O1 and O1' which are the centers of their outer arc-shaped surfaces but about the points O1' and O1 such that the thickness of both arc-shaped parts (34C, 34E) changes. Since the inner arc-shaped surface of the third arc-shaped part (34C) and the inner arc-shaped surface of the fifth arc-shaped part (34E) are formed about the points O1' and O1, respectively, the inner arc-shaped surface of the third arc-shaped part (34C) is formed and the outer inner arc-shaped surface of the fifth arc-shaped part (34E) is formed shorter than the case where the inner arc-shaped surface of the third arc-shaped part (34C) and the inner arc-shaped surface of the fifth arc-shaped part (34E) are formed about the points O1 and O1'. As a result, a longer compression passage can be formed in the outer compression chamber (41A) facing the inner surface of the third arc-shaped part (34C) and a shorter compression passage can be formed in the outer compression chamber (41A) facing the inner surface of the fifth arc-shaped part (34E).

According to the second embodiment, in the orbiting wrap (38), the inner arc-shaped surface of the second arc-shaped part (38B) and the inner arc-shaped surface of the fourth arc-shaped part (38D) are, referring to FIG. 9(B), formed not about the points O12 and O12' which are the centers of their outer arc-shaped surfaces but about the points O12' and O12 such that the thickness of both arc-shaped parts (38B, 38D) changes. Since the inner arc-shaped surface of the second arc-shaped part (38B) and the inner arc-shaped surface of the fourth arc-shaped part (38D) are formed about the points O12' and O12, the inner arc-shaped surface of the second arc-shaped part (38B) is formed longer and the inner arc-shaped surface of the fourth arc-shaped part (38D) is formed shorter than the case where the inner arc-shaped surface of the second arc-shaped part (38B) and the inner arc-shaped surface of the fourth arc-shaped part (38D) are formed about the points O12 and O12. As a result, a longer compression passage can be formed in the inner compression chamber (41B) facing the inner surface of the second arc-shaped part (38B) and a shorter compression passage can be formed in the inner compression chamber (41B) facing the inner surface of the fourth arc-shaped part (38D).

As described above, in the second embodiment, the fixed wrap (34) and the orbiting wrap (38) each include the parts, the thickness of which changes from the outer end to the inner end, such that the rate of change in volume of at least one of the outer compression chamber (41A) and the inner compression chamber (41B) is reduced in the middle of the compression phase. Specifically, in the fixed wrap (34), the third arc-shaped part (34*c*) allows reduction in volume change rate of the outer compression chamber (41A). The inner arc-shaped surface of the fifth arc-shaped part (34E) always faces the outer compression chamber (41A) in the discharge phase communicating with the discharge port, and thus does not contribute to the compression of the refrigerant. Moreover, in the orbiting wrap (38), the second arc-shaped part (38B) allows reduction in volume change rate of the inner compression chamber (41B). The inner arc-shaped surface of the fourth arc-shaped part (38D) always faces the inner compression chamber (41B) in the discharge phase communicating with the discharge port, and thus does not contribute to the compression of the refrigerant.

In the scroll compressor (10) of the second embodiment, when an electric motor (20) is operated, an orbiting scroll (36) of a compression mechanism (30) eccentrically rotates about the center of a drive shaft (60) as in the first embodiment. An suction phase, the compression phase, and a discharge phase are, as in the first embodiment, performed in the outer compression chamber (41A) and the inner compression chamber (41B). In the scroll compressor (10) of the second embodiment, the inner compression chamber (41B) and the outer compression chamber (41A) are formed such that the volume change rate thereof is reduced in the middle of the compression phase. Thus, although the cross-sectional area of a passage through which each of the outer compression chamber (41A) and the inner compression chamber (41B) communicates with a discharge port (35) is small right after the beginning of the discharge phase, the rate of change in volume of each of the outer compression chamber (41A) and the inner compression chamber (41B) (i.e., the rate of reduction in volume of each of the outer compression chamber (41A) and the inner compression chamber (41B)) is reduced to a relatively-low volume change rate, and therefore over-compression in the outer compression chamber (41A) and the inner compression chamber (41B) right after the beginning of the discharge phase is reduced. Consequently, according to the second embodiment, an over-compression loss can be, as in the first embodiment, reduced without increasing the size of the scroll compressor (10).

Note that the embodiments described above have been set forth merely for the purpose of preferred examples in nature, and are not intended to limit the scope, applications, and use of the invention.

INDUSTRIAL APPLICABILITY

As described above, the present disclosure is useful for a scroll compressor.

What is claimed is:

1. A scroll compressor comprising:

a fixed scroll; and an orbiting scroll each of the fixed scroll and the orbiting scroll including an end plate and a spiral wrap standing on a front surface of the end plate, the fixed scroll and the orbiting scroll being arranged such that the front surfaces of the end plates face each other and the wraps are engaged with each other, the orbiting scroll eccentrically rotating, without turning on an axis thereof, with respect to the fixed scroll to compress fluid in compression chambers respectively formed inside and outside the wrap of the orbiting scroll, each wrap of the fixed scroll and the orbiting scroll being formed in a shape such that at least one of the compression chambers serves as a rate-reduced compression chamber where a volume change rate thereof is reduced in a middle of a compression phase, and each wrap of the fixed scroll and the orbiting scroll being formed such that the volume change rate of the rate-reduced compression chamber changes, with eccentric rotation of the orbiting scroll, from a first volume changes, rate to a second volume change rate lower than the first volume change rate, and the change in volume change rate is completed when a rotation angle of the orbiting scroll falls within a range of plus or minus 90 degrees of an angle at which a discharge phase begins in the rate-reduced compression chamber.

2. The scroll compressor of claim 1, wherein each wrap of the fixed scroll and the orbiting scroll is formed in an involute curve shape, and a side surface of each wrap facing the rate-reduced compression chamber is formed in a shape of a modified involute curve such that a base circle radius decreases in a stepwise manner from an outer end to an inner end of each wrap.

3. The scroll compressor of claim 2, wherein each wrap of the fixed scroll and the orbiting scroll is configured such that the modified involute curve has a change point at which the base circle radius changes, and a base circle of an involute curve on an inner end side relative to the change point and a base circle of an involute curve on an outer end side relative to the change point have an identical tangent line passing through the change point.

4. The scroll compressor of claim 3, wherein each wrap of the fixed scroll and the orbiting scroll is formed in an asymmetric shape, and is formed such that at least the compression chamber formed inside the wrap of the orbiting scroll serves as the rate-reduced compression chamber.

5. The scroll compressor of claim 2, wherein each wrap of the fixed scroll and the orbiting scroll is formed in an asymmetric shape, and is formed such that at least the compression chamber formed inside the wrap of the orbiting scroll serves as the rate-reduced compression chamber.

6. The scroll compressor of claim 1, wherein each wrap of the fixed scroll and the orbiting scroll is formed in an asymmetric shape, and is formed such that at least the compression chamber formed inside the wrap of the orbiting scroll serves as the rate-reduced compression chamber.

7. The scroll compressor of claim 1, wherein each wrap of the fixed scroll and the orbiting scroll is formed by a plurality of arc-shaped parts continuing from each other such that an arc radius decreases from an outer end to an inner end of each wrap, and in each wrap of the fixed scroll and the orbiting scroll, some of the arc-shaped parts have a thickness changing from the outer end to the inner end of each wrap such that the volume change rate of the rate-reduced compression chamber is reduced in the middle of the compression phase.

* * * * *